US006360943B1

(12) United States Patent
Focke et al.

(10) Patent No.: US 6,360,943 B1
(45) Date of Patent: Mar. 26, 2002

(54) FLIP-TOP BOX FOR CIGARETTES

(75) Inventors: Heinz Focke; Jürgen Focke, both of Verden; Henry Buse, Visselhövede, all of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/913,499

(22) PCT Filed: Jan. 21, 1999

(86) PCT No.: PCT/EP99/10037

§ 371 Date: Aug. 16, 2001

§ 102(e) Date: Aug. 16, 2001

(87) PCT Pub. No.: WO00/48926

PCT Pub. Date: Aug. 24, 2000

(30) Foreign Application Priority Data

Feb. 17, 1999 (DE) ..... 199 064 733

(51) Int. Cl.[7] ..... B65D 85/10
(52) U.S. Cl. ..... 229/160.1; 206/273; 229/146
(58) Field of Search ..... 229/146, 160.1; 206/268, 273

(56) References Cited

U.S. PATENT DOCUMENTS

| | | | | | |
|---|---|---|---|---|---|
| 1,877,955 | A | * | 9/1932 | Ottinger | 206/273 |
| 2,951,626 | A | * | 9/1960 | Weiss | 229/160.1 |
| 4,742,955 | A | * | 5/1988 | Focke et al. | 229/160.1 |
| 5,314,062 | A | * | 5/1994 | Wu et al. | 206/268 |
| 5,749,462 | A | * | 5/1998 | Houghton | 229/160.1 |
| 5,788,066 | A | * | 8/1998 | Focke et al. | 206/273 |
| 5,921,384 | A | * | 7/1999 | Focke et al. | 229/160.1 |
| 6,199,687 | B1 | * | 3/2001 | Tambo et al. | 206/273 |

FOREIGN PATENT DOCUMENTS

| | | | | |
|---|---|---|---|---|
| EP | 205766 | A1 | * 12/1986 | |
| FR | 1280052 | | * 11/1961 | |
| FR | 89792 | | * 7/1967 | |
| FR | 2642405 | A1 | * 8/1990 | 229/160.1 |
| GB | 2229996 | A | * 1/1990 | |
| WO | 96/09230 | A1 | * 3/1996 | |

* cited by examiner

*Primary Examiner*—Gary E. Elkins
(74) *Attorney, Agent, or Firm*—Sughrue Mion, PLLC

(57) ABSTRACT

Hinge-lid boxes usually comprise a box part (10) and a lid (11) connected in an articulated manner thereto. In the region of a box front wall (15) and lid front wall (19), the box part (10) and lid (11) form transversely directed closure edges, namely a lid closure edge (33) and mating closure edge (34). These closure edges are of V-shaped design with different angles between the associated edge legs (37, 38 and 39, 40, respectively), with the result that a V-shaped or arrowhead-like opening (43) is formed.

10 Claims, 8 Drawing Sheets

Figure 2:
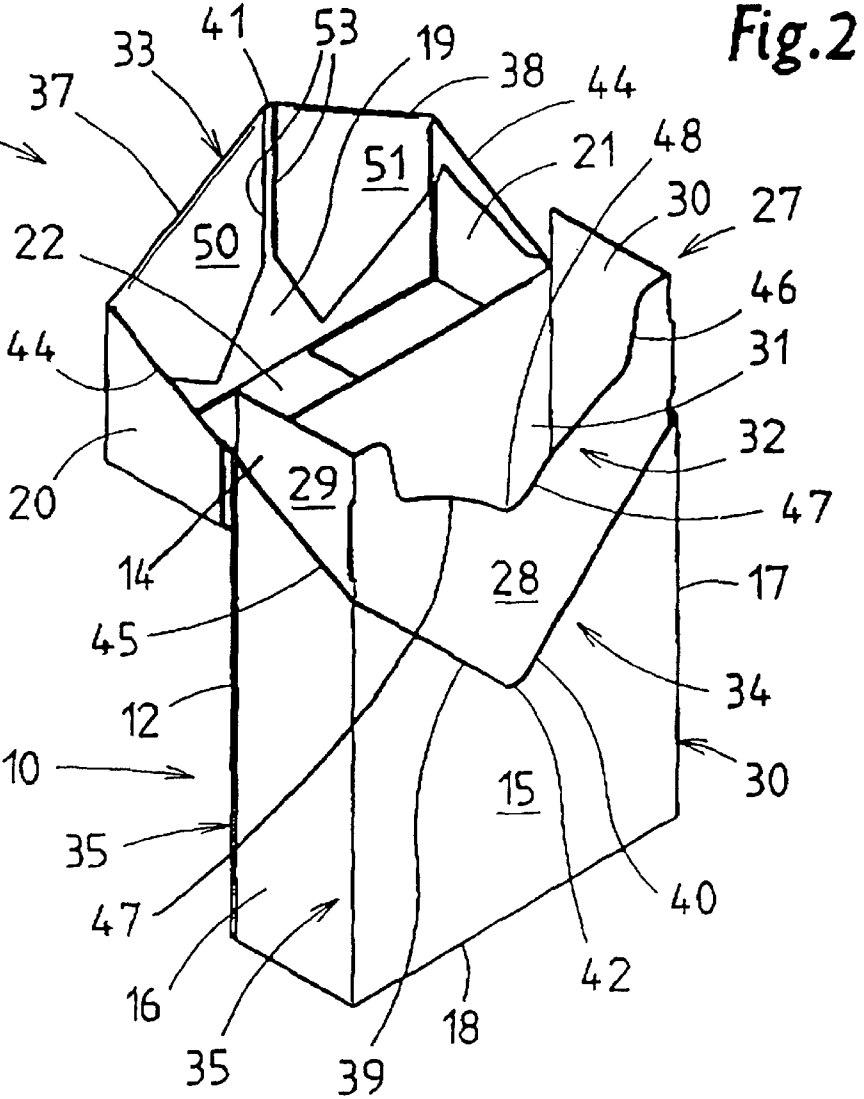

27
46
31
32
47
17
34
30
48
30
40
44
21
42
38
28
15
19
18
51
39
53
29
41
50
35
33
14
45
12
16
37
22
44
20
35
47
10

11
41
47
21
38
40
42
17
32
19
15
18
22
47
27
20
37
39
16
43

27
30
31
47
32
48
40
34
42
36
14
38
33
41
37
51
50
19
22
28
15
44
20
58
47
39
56
35
57
10
11

21
41
58
38
40
36
57
58
22
32
19
15
42
33
34
20
44
37
43
39
57
56
16
35

27
46
31
47
40
34
36
42
48
44
38
33
41
37
51
19
22
50
15
20
44
45
47
39
35
11
10

44/45
41
38
40
36
59
33
32
37
19
15
43
34
44/45
39
42
59
35

FLIP-TOP BOX FOR CIGARETTES

The invention relates to a hinge-lid box for cigarettes or similar products, having a box part and a lid articulated on a box rear wall, and having a collar which is anchored in the box part and has a collar front wall and collar side walls and has its region which projects out of the box part enclosed by the lid in the closed position, a lid front wall being bounded by a (bottom) lid closure edge and a box front wall of the box part being bounded by a (top) mating closure edge.

Conventional hinge-lid boxes are designed such that the transversely directed lid closure edge, in the closed position, butts against the likewise transversely directed mating closure edge of the box part. Also already known, however, is a hinge-lid box with an obliquely running lid closure edge and correspondingly obliquely running mating closure edge, the lid closure edge being spaced apart from the mating closure edge, which is arranged parallel thereto, with the result that a strip-like region of the collar front wall can also be seen in the closed position of the lid.

The object of the invention is to develop (cigarette) packs of the hinge-lid-box type further, in particular in terms of the configuration of the front side, and also to improve the handling of the same.

In order to achieve this object, the hinge-lid box according to the invention is characterized in that, with the lid closed, the lid closure edge and mating closure edge are spaced apart from one another by distances which change over the pack width, and in the region of lateral, upright pack edges converge until they come into contact with one another.

The lid closure edge, on the one hand, and the mating closure edge, on the other hand, are preferably of V-shaped design with different angles of inclination of closure-edge-forming edge legs. It is thus the case that the lid closure edge, on the one hand, and the mating closure edge, on the other hand, bound a front recess or opening which is backed by the collar front wall. The latter can thus be seen in the region of said opening On account of the configuration and arrangement of the closure edges according to the invention, with the lid closed, the opening is of V-shaped configuration with rectilinear edge legs and with a width or height which decreases in the direction of the ends. In the region of lateral, upright pack edges, the top and bottom closures edges converge until they come into contact with one another. The V-shaped opening between the (closed) lid and box part has legs or vanes which taper to a point in the direction of the ends. The width of the V-shaped opening may also be considerably smaller than the width of the front side of the pack. The opening is preferably positioned centrally on the front side of the pack, but may also be arranged in a laterally offset manner.

The abovedescribed configuration of the lid closure edge and of the mating closure edge can be used particularly advantageously in hinge-lid boxes with bevelled pack edges at least in the region of the pack front side, preferably in the case of octagonal packs with four bevelled pack edges or, in the case of packs with rounded pack edges, at least in the front region.

Further details and features of the invention concern the configuration of the hinge-lid box, of the collar and of the blanks for the hinge-lid box.

Figure 1:
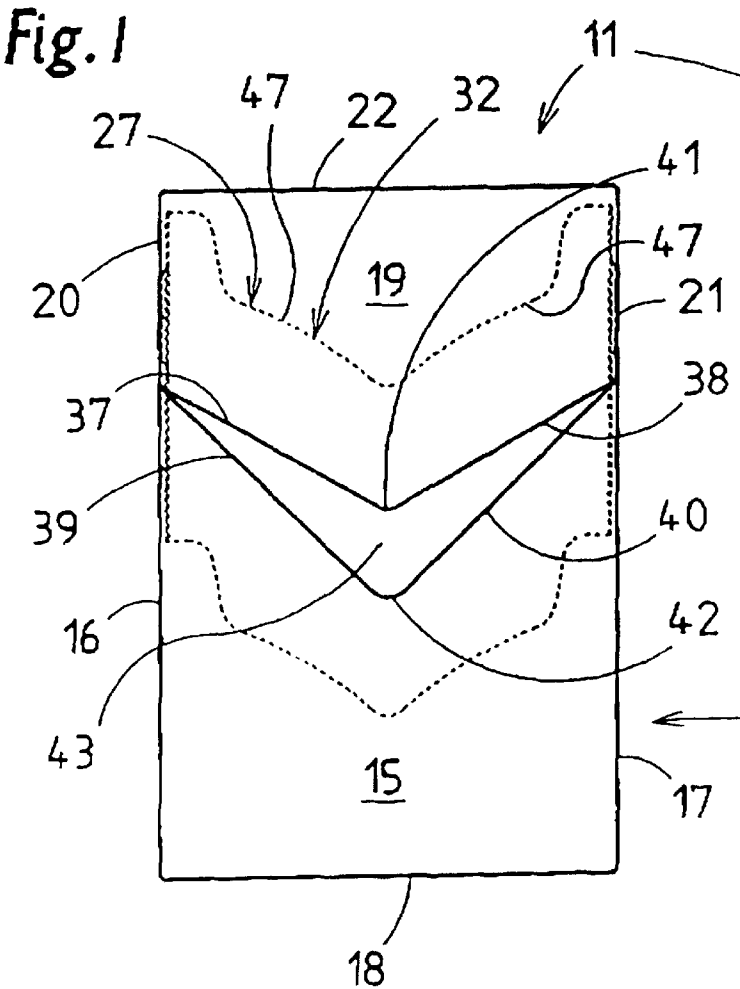
Figure 3:
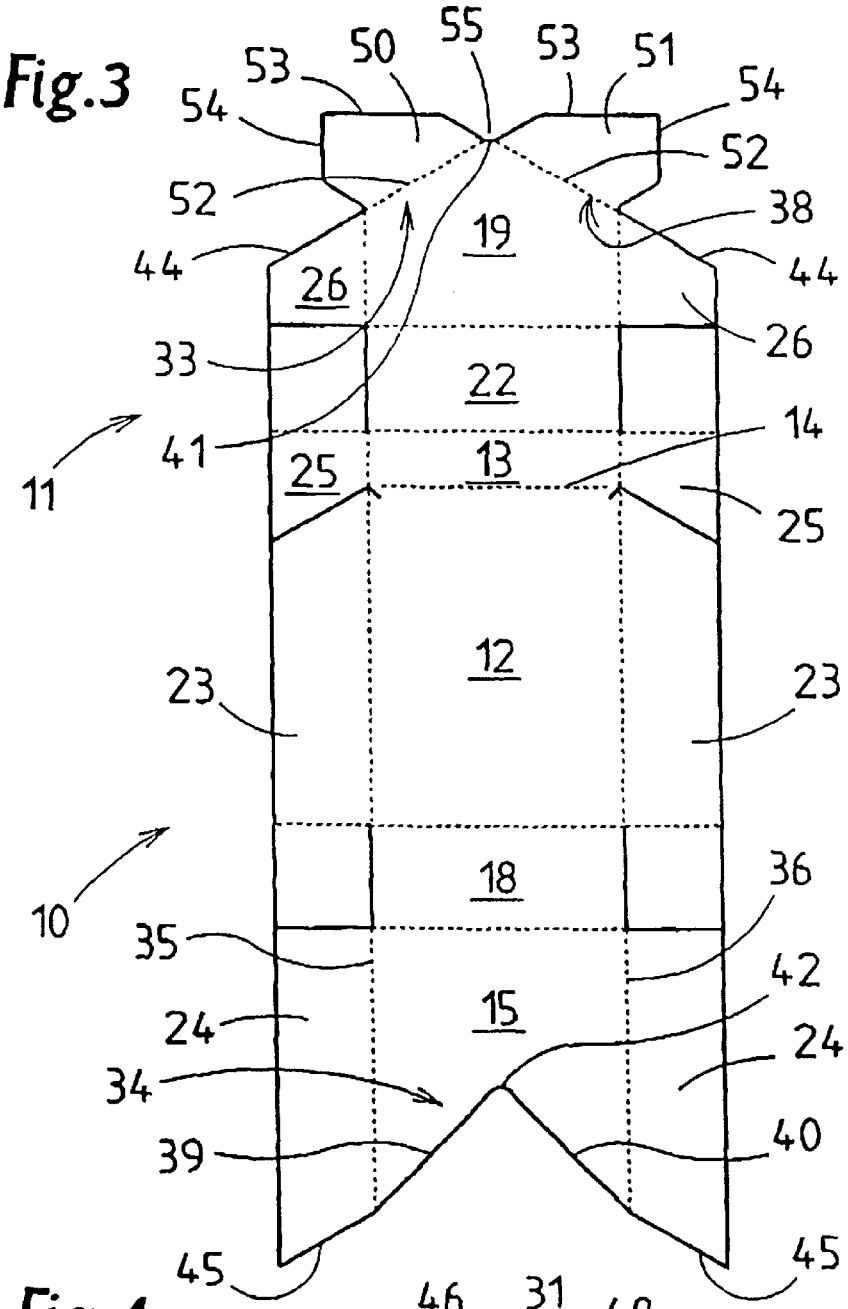
Figure 4:
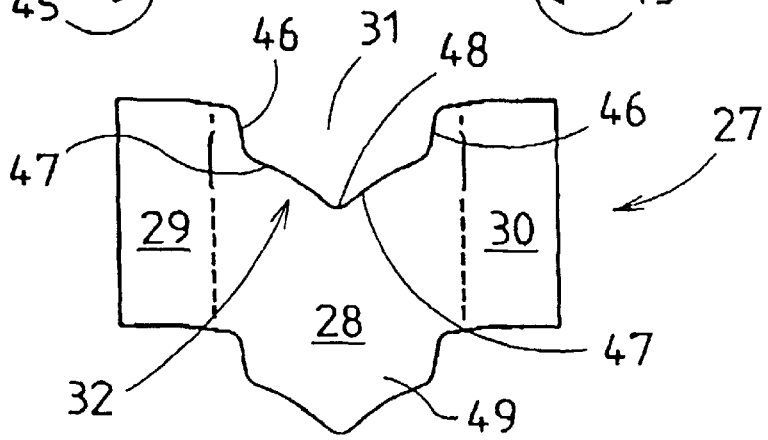
Figure 6:
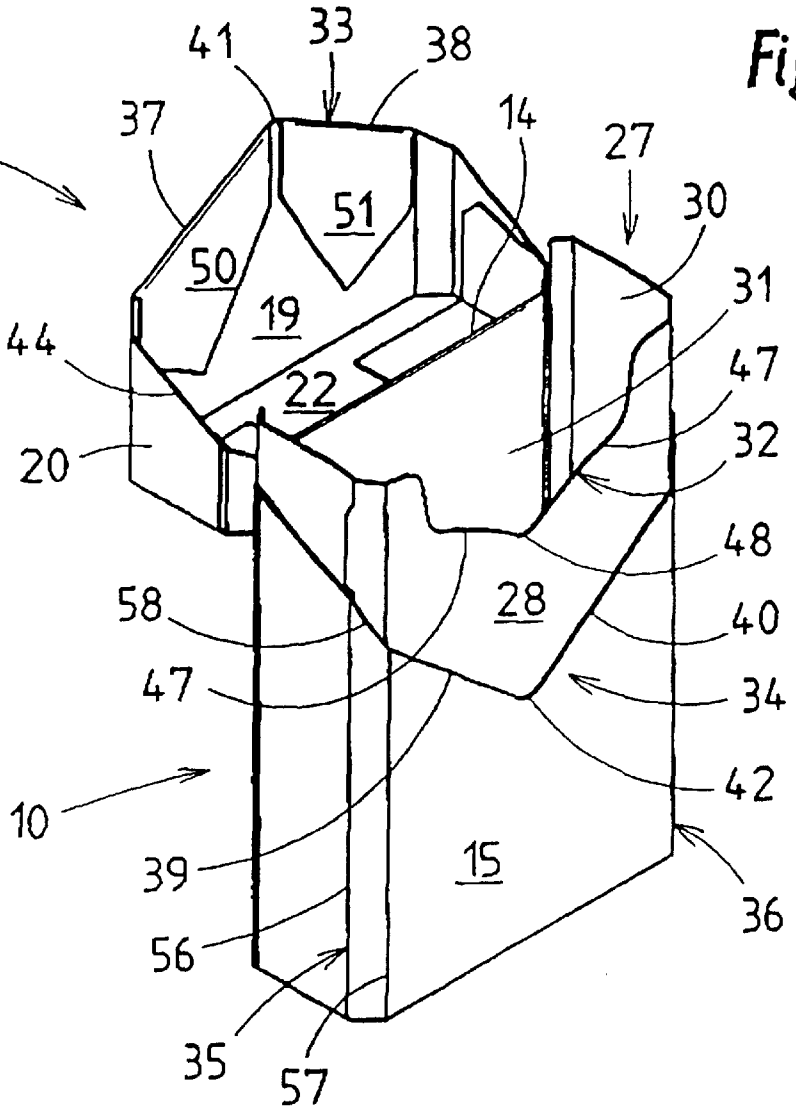
Figure 5:
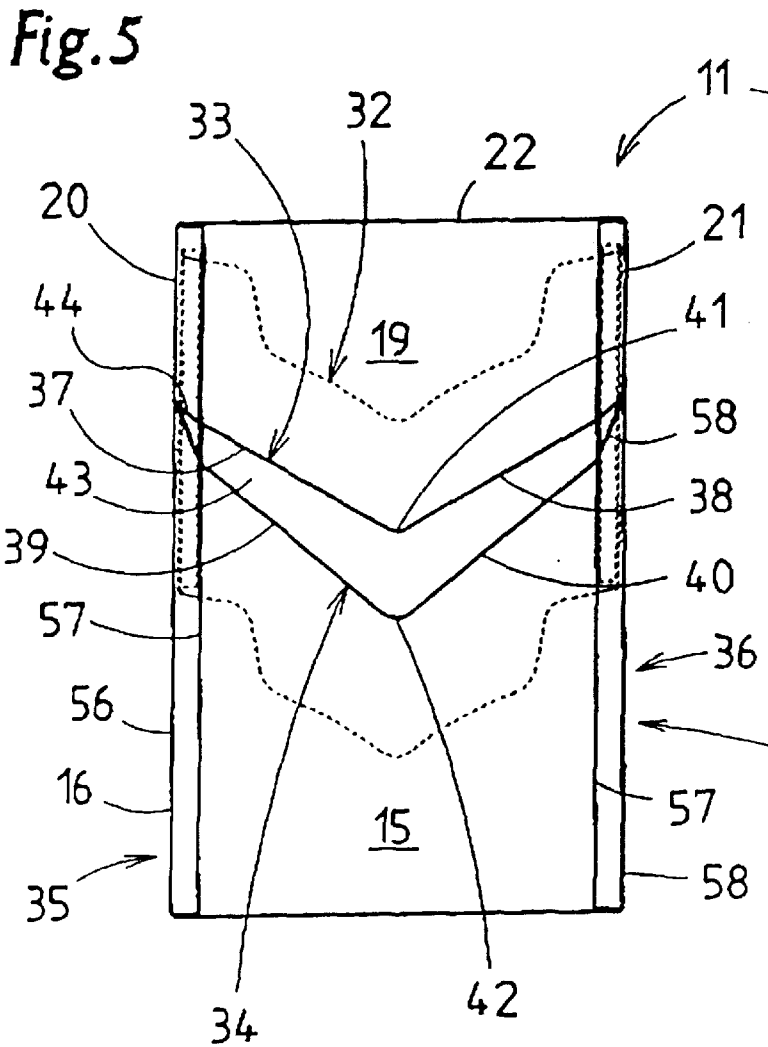
Figure 7:
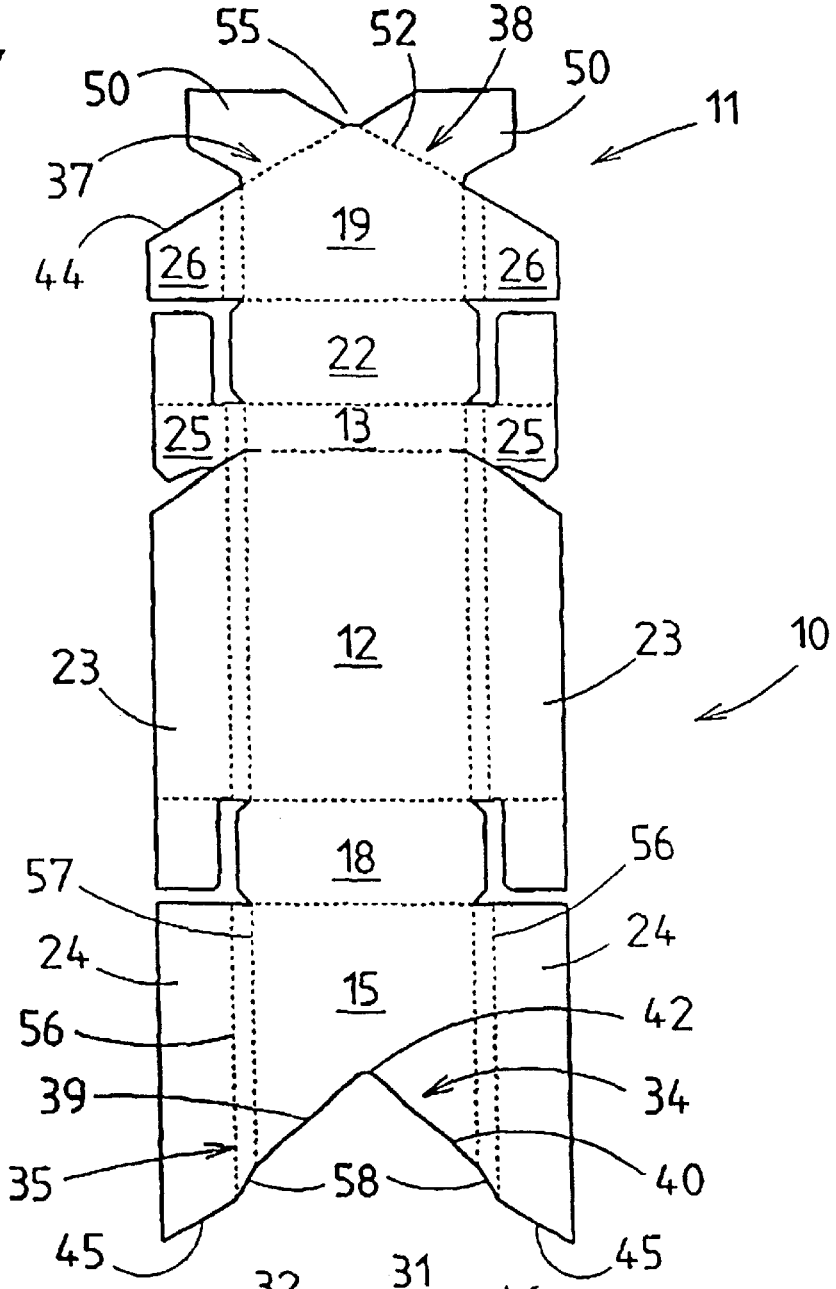
Figure 8:
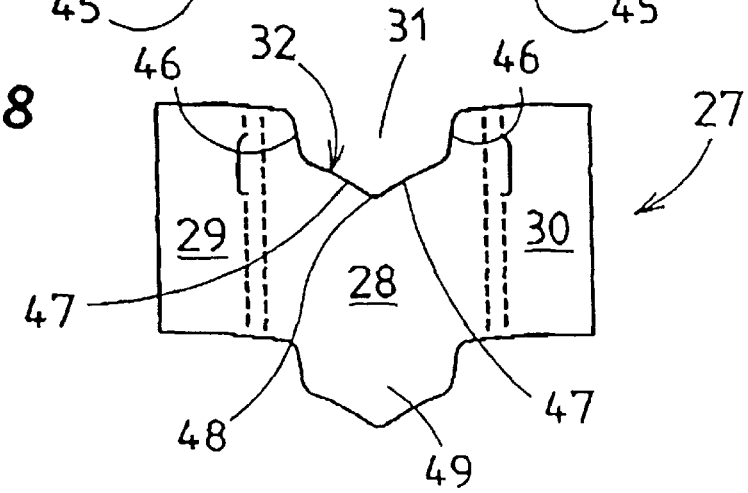
Figure 10:
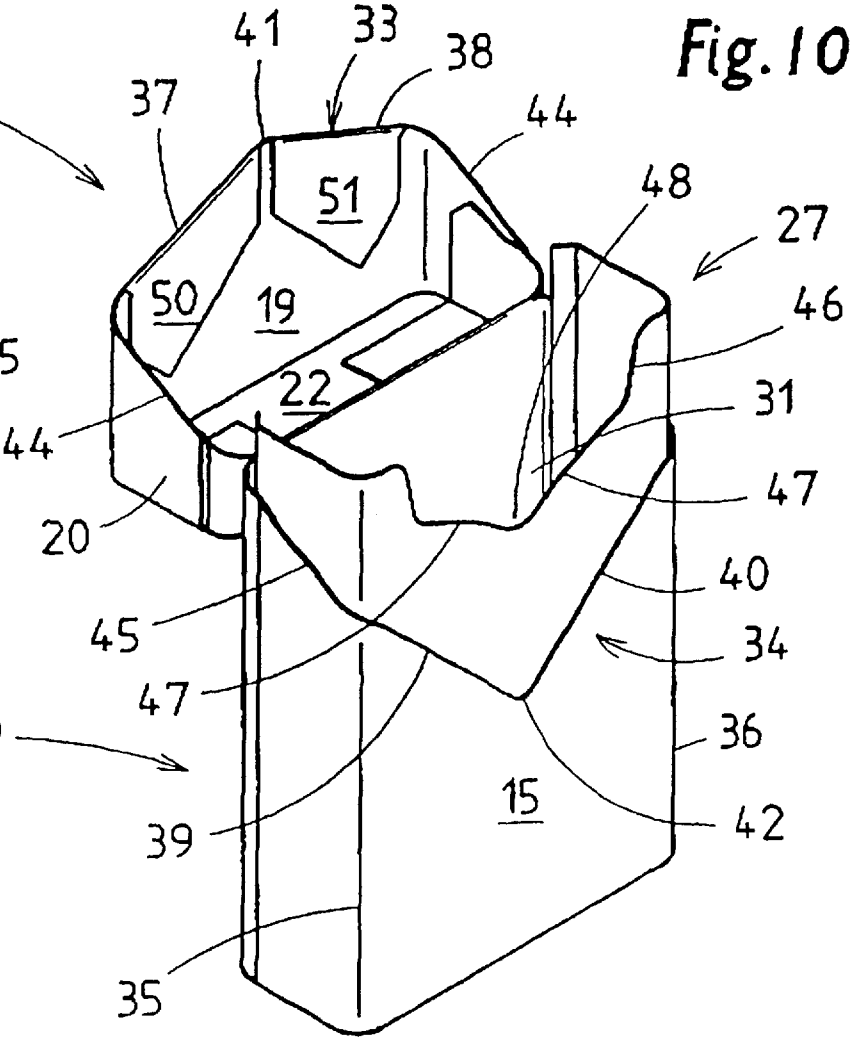
Figure 9:
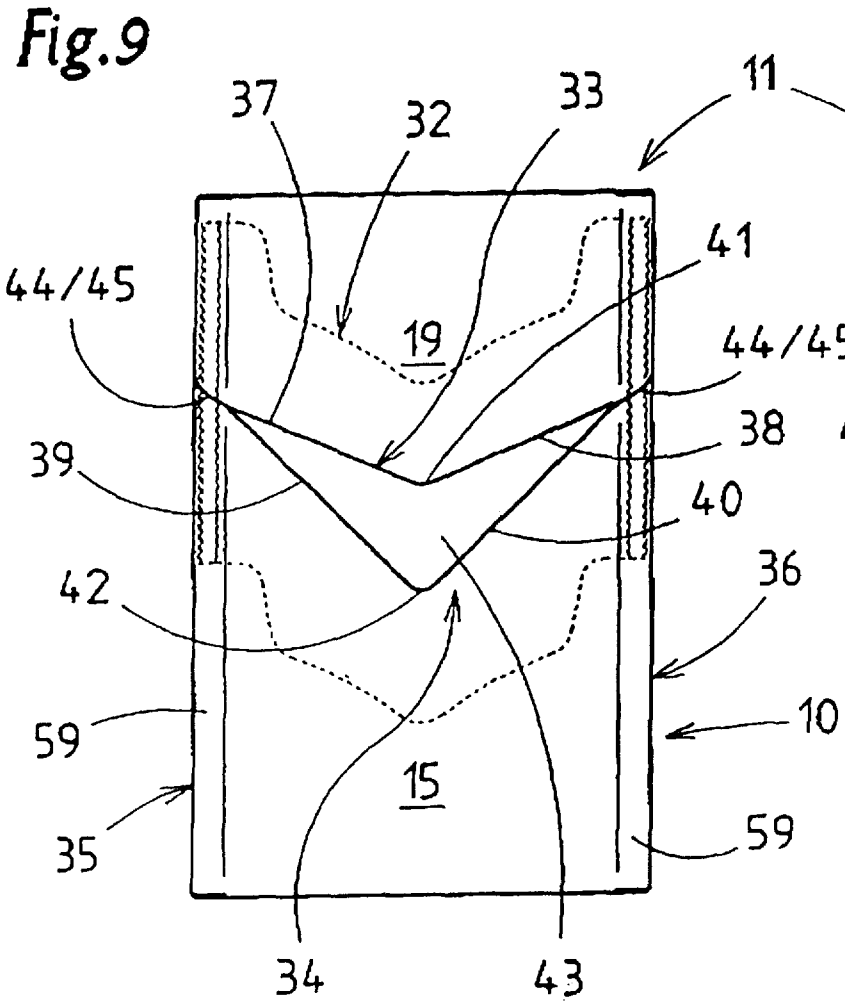
Figure 11:
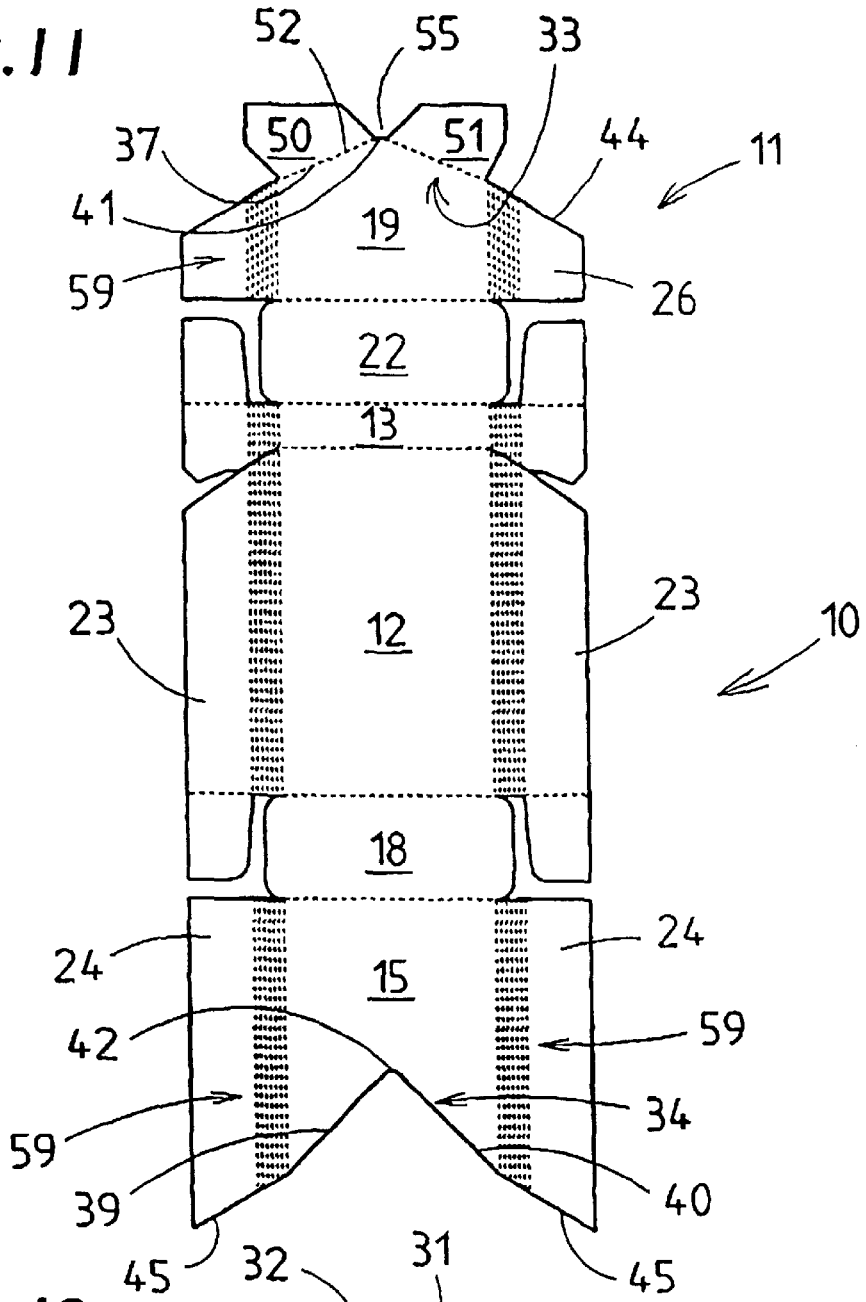
Figure 12:
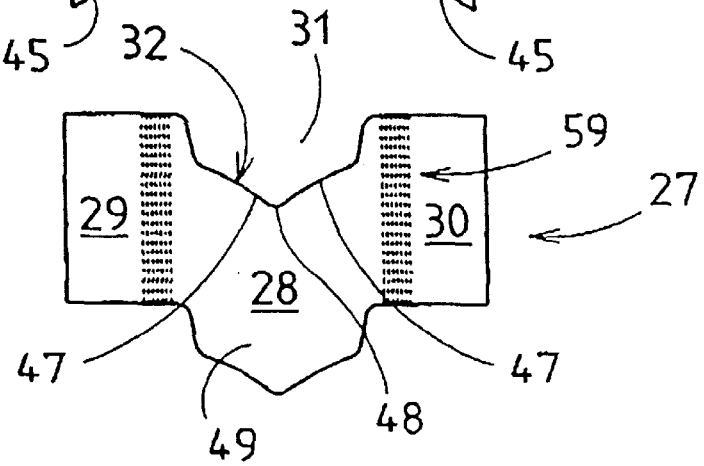
Figure 14:
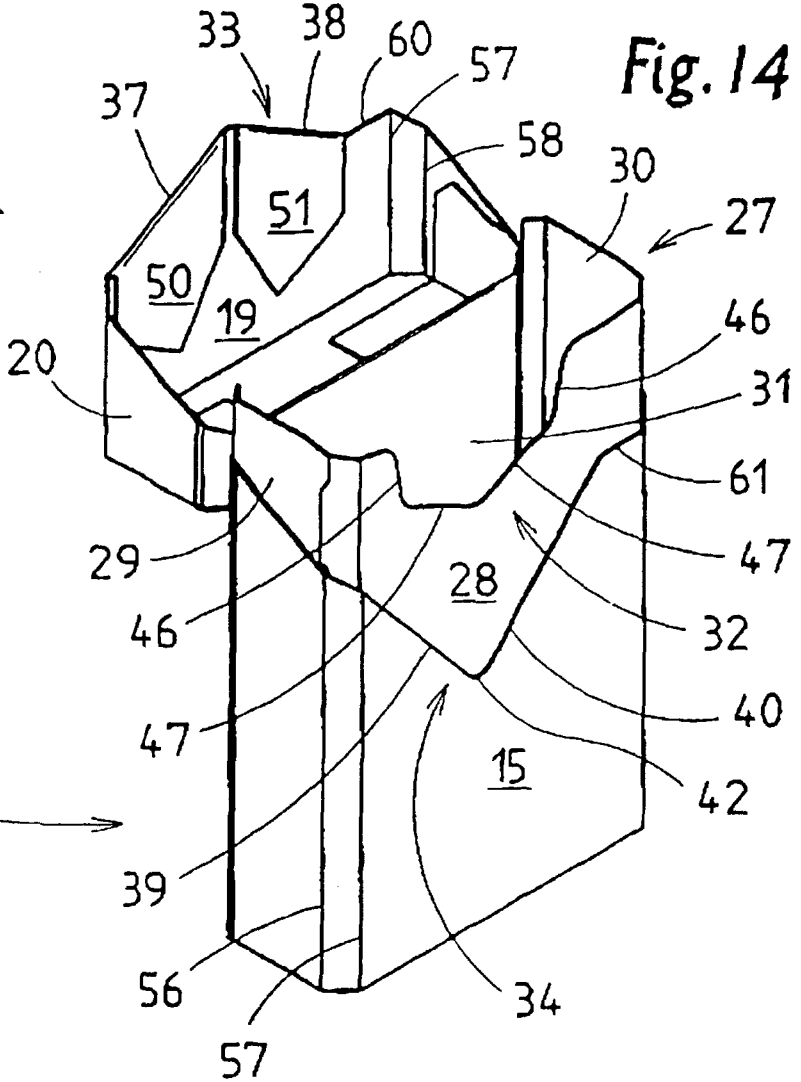
Figure 13:
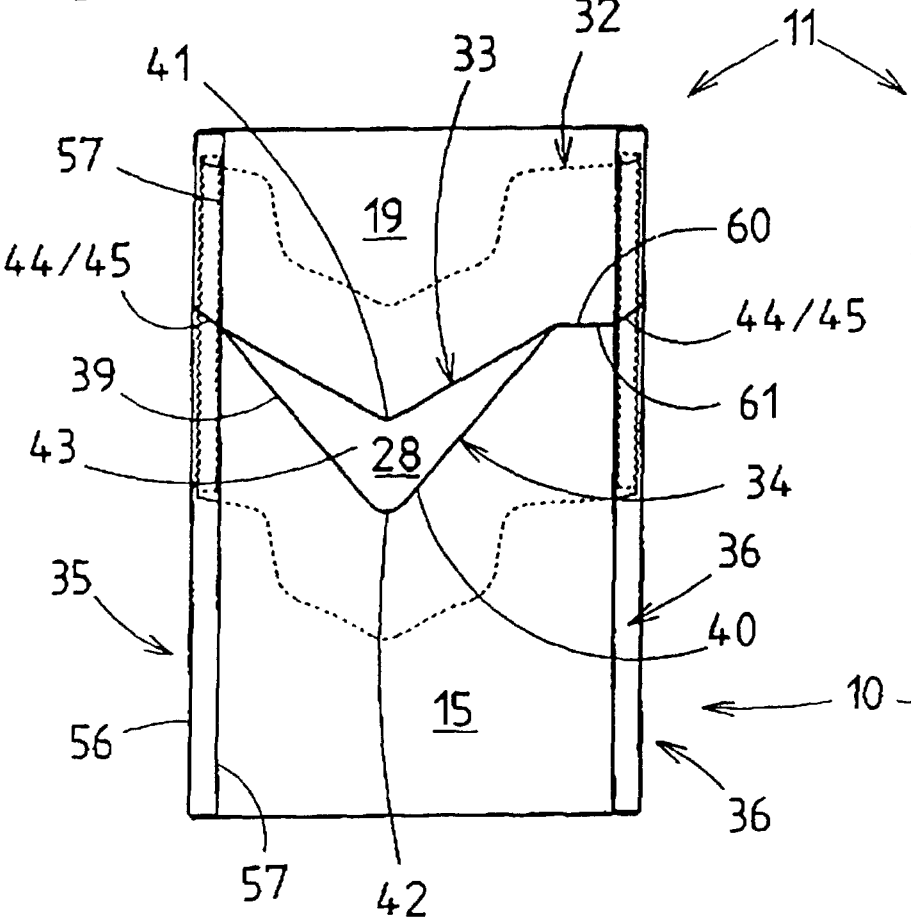
Figure 15:
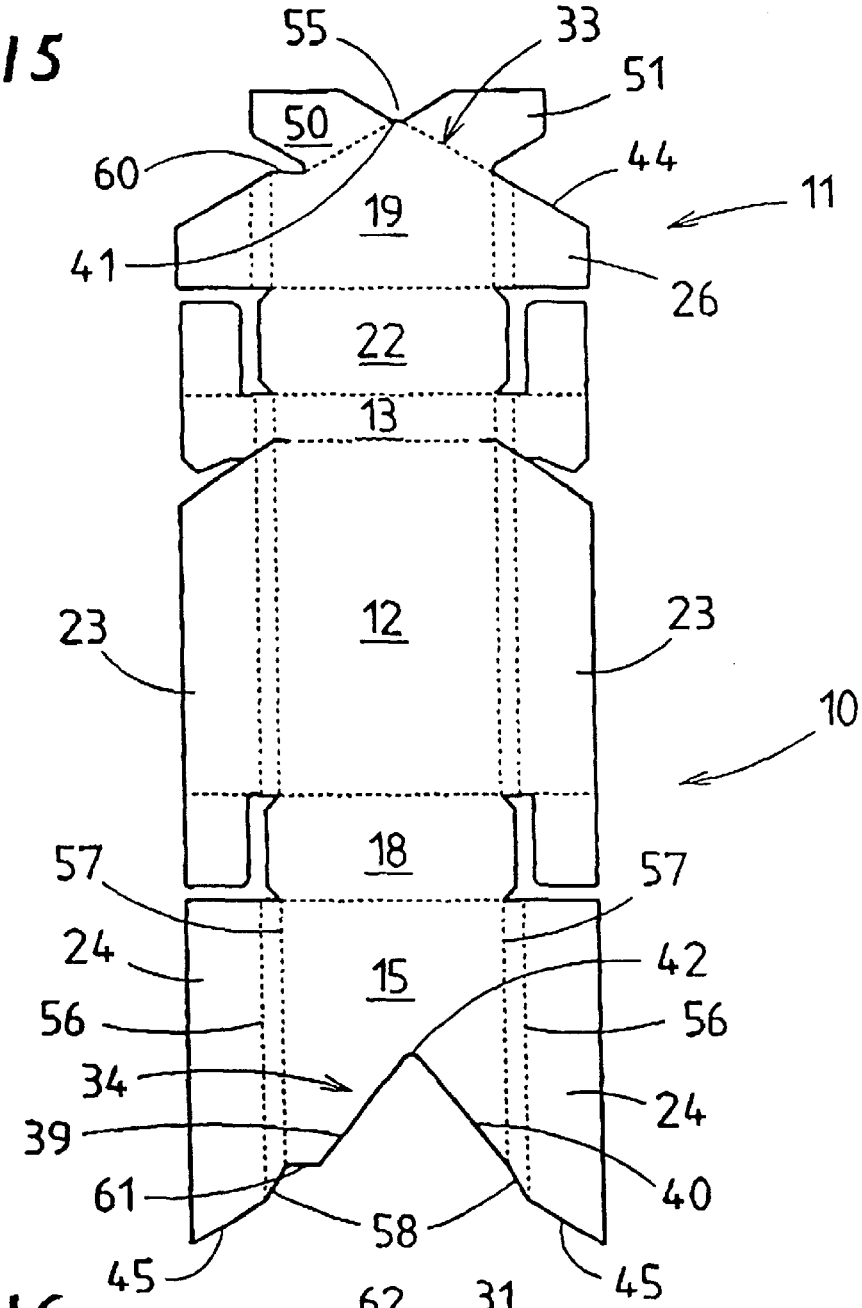
Figure 16:
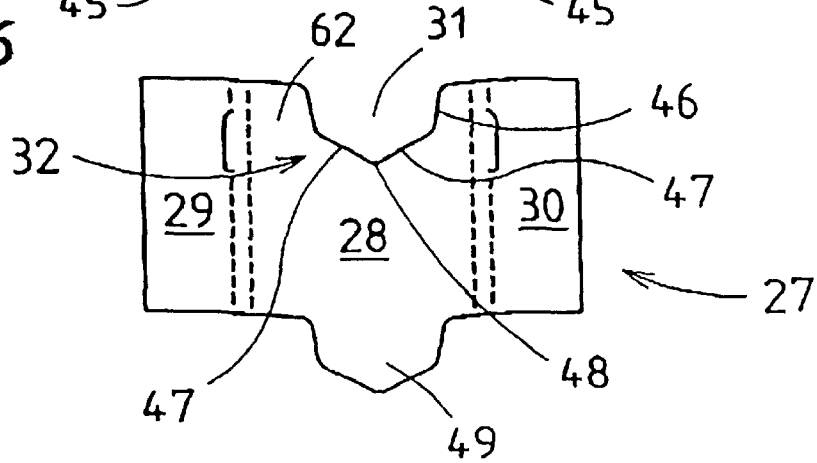

Exemplary embodiments of the pack according to the invention and of parts of the same are explained in more detail hereinbelow with reference to the drawings, in which:

FIG. 1 shows a front view of a hinge-lid box for cigarettes with the lid closed, FIG. 2 shows a perspective illustration of the hinge-lid box according to FIG. 1 with the lid open, FIG. 3 shows a spread-out blank for a hinge-lid box according to FIGS. 1 and 2, FIG. 4 shows a spread-out blank for a collar of the hinge-lid box according to FIGS. 1 and 2, FIG. 5 shows an illustration analogous to FIG. 1 for another embodiment of a hinge-lid box, FIG. 6 shows an illustration analogous to FIG. 2 for the hinge-lid box according to FIG. 5, FIG. 7 shows a spread-out blank for a hinge-lid box according to FIGS. 5 and 6, FIG. 8 shows a spread-out blank for a collar of the hinge-lid box according to FIGS. 5 and 6, FIG. 9 shows an illustration analogous to FIG. 1 for a further exemplary embodiment of a hinge-lid box, FIG. 10 shows a perspective illustration of the hinge-lid box according to FIG. 9 with the lid open, FIG. 11 shows a spread-out blank for a hinge-lid box according to FIGS. 9 and 10, FIG. 12 shows a spread-out blank for a collar of a hinge-lid box according to FIGS. 9 and 10, FIG. 13 shows a fourth exemplary embodiment of a hinge-lid box in an illustration analogous to FIG. 1, FIG. 14 shows a perspective illustration of the hinge-lid box according to FIG. 13 with the lid open, FIG. 15 shows a spread-out blank for a hinge-lid box according to FIGS. 13 and 14, and FIG. 16 shows a spread-out blank for a collar of the hinge-lid box according to FIGS. 13 and 14.

Hinge-lid boxes comprise a (bottom) box part 10 and a (top) lid 11 connected thereto. The box part 10 and the lid 11 are connected to one another via a transversely directed articulation 14 in the region of a box rear wall 12, on the one hand, and of a lid rear wall 13, on the other hand. The box part 10 also comprises a box front wall 15 and box side walls 16, 17. The bottom termination of-the box part 10 is formed by a base wall 18.

Analogously to this, the lid 11 comprises a lid front wall 19, lid side walls 20, 21 and an end wall 22.

The box side walls 16, 17 and, accordingly, the lid side walls 20, 21 respectively comprise side tabs 23, 24 and lid side tabs 25, 26, which overlap one another wholly or partially. Mutually assigned side tabs are connected to one another by adhesive bonding. Furthermore, a lid inner tab of specific configuration is connected to a free border of the lid front wall 19 and is folded over against the inside of the same and fastened thereon.

A hinge-lid box of classic construction also has a collar 27. The latter comprises a separate blank. The collar 27 comprises a collar front wall 28 and collar side walls 29, 30. An upwardly open cutout 31 of specific configuration is located in the region of the collar front wall 28. The cutout 31 is bounded by a collar edge 32.

A special feature of the present hinge-lid boxes is the configuration of closure edges of the box part 10, on the one hand, and of the lid 11, on the other hand. The lid front wall 19 forms a lid closure edge 33 by way of the bottom border. When a lid inner tab is present, said lid closure edge is formed by a folding edge of the lid inner tab and of the lid front wall 19.

In the case of conventional hinge-lid boxes, with the lid 11 closed, the lid closure edge 33 butts against a mating closure edge 34, which is formed by a top border of the lid front wall 15. The present hinge-lid boxes are designed such that the closure edges 33, 34 are spaced apart from one another, to be precise over the entire width of the pack front side or over a sub-region of the same. The distance between the closure edges 33, 34 decreases uniformly in the direction of the sides of the hinge-lid box, namely in the direction of the lateral, upright pack edges 35, 36.

The closure edges 33, 34 are of V-shaped design, namely with two edge legs 37, 38 and 39, 40, respectively, arranged at an angle to one another. The edge legs 37, 38 together form the lid closure edge 33, and the edge legs 39, 40 each form sections of the mating closure edge 34. In the exemplary embodiment of FIG. 1, the edge legs 37, 38 are oriented at an obtuse angle to one another, a shallow, elongate V-contour being formed in the process. The edge legs 37, 38 converge at a downwardly directed point 41, which is rounded.

The edge legs 39, 40 of the (bottom) mating closure edge 34 are oriented at a smaller angle to one another than the edge legs 37, 38, approximately at right angles according to FIG. 1. The edge legs 39, 40 also converge at a point 42 which is rounded to a pronounced extent.

The points 41, 42 are arranged one beneath the other, to be precise on an (imaginary) vertical line parallel to the pack edges 35, 36. Furthermore, the points 41, 42 are positioned centrally on the front side of the hinge-lid box.

In the region of the front side of the pack, the V-shaped closure edges 33, 34, with the lid 11 closed, bound an opening 43 which in accordance with the profile of the closure edges 33, 34, is of V-shaped design, to be precise with a transverse dimension decreasing in the direction of the sides, that is to say in the direction of the pack edges 35, 36. The opening 43 has an arrowhead-like configuration with preferably two equally sized vanes tapering to a point in the direction of the sides. In the region of this opening 43, it is possible to see part of the pack located therebeneath, in the present case the collar front wall 28.

The converging edge legs 37 and 39, on the one hand, and 38 and 40, on the other hand, converge in a lateral region of the pack front side. The exemplary embodiment according to FIGS. 1 to 4 is a hinge-lid box with cross-sectionally right-angled pack edges 35, 36. The edge legs 37 . . . 40 extend as far as said pack edges 35, 36 and converge at the border of the pack front side, namely in the region of the front pack edges 35, 36. The edge legs 37 . . . 40 merge into obliquely directed side closure edges 44, 45 in the region of side walls 16, 17 and 20, 21 of the box part 10 and lid 11, respectively.

The collar 27 is also of specific design. The cutout 31 is adapted, in terms of the contour, to the configuration of the closure edges 44, 45, namely is of V-shaped configuration in principle. The collar edge 32 forms upright or obliquely running end sections 46 and edge sections 47 which adjoin said end sections and converge in a V-shaped manner. Said edge sections converge at a downwardly directed, rounded point 48, which is aligned with the points 41, 42 of the closure edges 33, 34, namely is positioned precisely above the same. The transitions between the edge-sections 47, on the one hand, and the end sections 46, on the other hand, are rounded. The point 48 is likewise rounded. In the exemplary embodiment according to FIG. 4, provision is also made for the edge sections 47 to run in a slightly curved, arcuate manner, that is to say not to be of strictly rectilinear design.

At the bottom end, the collar 27 has a protrusion 49, of which the geometrical configuration corresponds precisely to the cutout 31, with the result that the blanks of the collar 27 can be severed from a corresponding web in a waste-free manner.

The lid inner tab is also of specific design. This is because it comprises two sub-tabs 50, 51 which together form the lid inner tab. Arranged on each edge leg 37, 38 of the lid closure edge 33 is a sub-tab 50, 51, and these are thus directed obliquely or can be folded about an obliquely running folding line 52. The sub-tabs 50, 51 have a more or less trapezoidal or roof-shaped contour with a transverse edge 53 which extends transversely to the longitudinal alignment of the blank (FIG. 3). This is adjoined laterally by a longitudinal edge 54 which runs precisely in the longitudinal direction of the blank. The two sub-tabs 50, 51 are separated from one another in the centre by a V-shaped depression 55. The abovedescribed geometrical contour of the sub-tabs 50, 51 means that, once they have been folded over against the inside of the lid front wall 19, they butt closely against one another and are separated from one another merely by a narrow, central gap which is bounded by the transverse edges 53. The lid closure edge 33 is thus of double-layered design, with a folding edge, over the entire length, namely in the region of the two edge legs 37, 38.

In that region of blank according to FIG. 3 which is located opposite the sub-tabs 50, 51 an overall V-shaped contour is formed for end-boundary purposes, said contour also extending in the region of the (outer) side tabs 24. The closure edge 45, which bounds said side tabs 24, is oriented at an obtuse angle to the adjoining edge legs 39, 40.

The packs, namely hinge-lid boxes, according to FIGS. 5 to 8, combine the V-shaped configuration of the closure edges 33, 34 with a specific pack contour, namely with an octagonal pack of a configuration which is known in principle (U.S. Pat. No. 4,753,384). In the case of this pack type, the front and rear pack edges 35, 36 are bevelled, two parallel folding edges, namely an outer edge 56 and an inner edge 57, being formed in the process.

In this exemplary embodiment, the lid closure edge 33 and the mating closure edge 34 extend beyond the inner edge 57 as far as the outer edge 56, that is to say right up to the box side walls 16, 17 and lid side walls 20, 21, respectively. In the region of the inner edges 57, the lid closure edge 33 and mating closure edge 34 are spaced apart from one another (slightly). The closure edges 33, 34 converge as far as the outer edge 56. In the region of the bevelled pack edges 35, 36, the profile of the closure edges 33, 34, namely the profile of the mating closure edge 34, differs from that in the region of the box front wall 15 by way of an edge section 58 as part of the mating closure edge 34 in the region between the outer edge 56 and inner edge 57 (FIG. 7). The edge section 58 is oriented at a more acute angle to said edges 56, 57.

FIGS. 9 to 12 show details of a hinge-lid box designed as a round-edge pack, namely with pack edges 35, 36 rounded in accordance with the dimensions of a cigarette. The blank (FIG. 11), for forming the round pack edges 35, 36, is provided with folding strips 59 which comprise a number of grooves which are located one beside the other and run in the longitudinal direction of the blank. Said round-edge pack otherwise corresponds to the design according to U.S. Pat. No. 4,753,363.

The V-shaped closure edges 33 and 34 are spaced apart from one another merely in the region of the box front wall 15 and lid front wall 19. The V-shaped opening 43 extends here exclusively in the region outside the (round) pack edges 35, 36, that is to say between the folding strips 59. A rectilinear side closure edge 45 is formed in the region of the folding strip 59 and of the adjacent side tabs 24. Said side closure edge extends at an obtuse angle to the edge legs 39, 40 of the box front wall 15.

FIGS. 13 to 16 show details of a hinge-lid box with a V-shaped opening 43 which is arranged in an offset manner in the region of the pack front side, that is to say outside an imaginary vertical centre line. The special feature is shown on a hinge-lid box with bevelled pack edges 35, 36, that is to say corresponding to the exemplary embodiment according to FIGS. 5 to 8. The edge legs 37 and 39 of the closure edges extend here as far as the inner edge 57. On the opposite side, the edge legs 38 and 40 merge at a position which is spaced apart from the inner edge 57. The closure edges 33 and 34 form abutting edge segments 60, 61 which run transversely, that is to say parallel to the end wall 22 and base wall 18. In the region of the (bevelled) front pack edge 36, the closure edges 33, 34 are angled again, in accordance with the oblique profile of the side closure edges 44 and 45.

On account of the smaller dimension of the resulting opening 43 in the transverse direction, the angles between the edge legs 37 . . . 40 are smaller, that is to say are oriented at an acute angle to one another between the (bottom) edge legs 39, 40 [sic].

The collar 27 (FIG. 16) is adapted to the above-described configuration of the pack, that is to say it is likewise provided with a laterally offset cutout 31, of which the point 48 is aligned with the points 41, 42 of the closure edges. The cutout 31 has a reduced width, with the result that a comparatively wide cross-piece 62 for bounding the cutout 31 is formed on one side.

The blank according to FIG. 15 is also of specific configuration. The edge segment 61, in the region of the box front wall 15, runs transversely as far as the inner edge 57. This is followed by an edge section 58 in the oblique direction. This is adjoined by the side closure edges 44, 45.

The sub-tab 50, as part of the lid inner tab, is likewise adapted, namely by the necessary edge segment 60, which produces a contour which differs slightly from the sub-tab 51. The lid front wall 19 is of single-layered design in the region of the edge segment 60.

It is also possible for the closure edges 33, 34 to be of slightly different configuration while maintaining the contour, namely to be curved slightly in the downward or upward direction to produce a wing-like contour of the opening 43.

LIST OF DESIGNATIONS

10 Box part
11 Lid
12 Box rear wall
13 Lid rear wall
14 Articulation
15 Box front wall
16 Box side wall
17 Box side wall
18 Base wall
18 Lid front wall
19 Lid side wall
20 Lid side wall
21 End wall
22 Side tab
23 Side tab
24 Lid side tab
25 Lid side tab
26 Collar
27 Collar front wall
28 Collar side tab
29 Collar side tab
30 Cutout
32 Collar edge
33 Lid closure edge
34 Mating closure edge
35 Pack edge
36 Pack edge
37 Edge leg
38 Edge leg
39 Edge leg
40 Edge leg
41 Point
42 Point
43 Opening
44 Side closure edge
45 Side closure edge
46 End section
47 Edge section
48 Point
49 Protrusion
50 Sub-tab
51 Sub-tab
52 Folding line
53 Transverse edge
54 Longitudinal edge
55 Depression
56 Outer edge
57 Inner edge
58 Edge section
59 Folding strip
60 Edge segment
61 Edge segment
62 Crosspiece

What is claimed is:

1. Hinge-lid box for cigarettes or the like, having a box part (10) and a lid (11) articulated on a box rear wall (12), and having a collar (27) made of a collar front wall (28) and collar side walls (29, 30), a lid front wall (19) being bounded via a bottom lid closure edge (33), and a box front wall (15) being bounded by a top mating closure edge (34) which, with the lid (11) closed, is spaced apart from the lid closure edge (33), characterized in that the lid closure edge (33) and/or the mating closure edge (34) have/has two downwardly directed edge legs (37, 38) which are arranged at an angle to one another and converge at a point (41, 42).

2. Hinge-lid box according to claim 1, characterized in that the point (41, 42) is located in the centre of the front side and is rounded.

3. Hinge-lid box according to claim 1, characterized in that the bottom lid closure edge (33) and the top mating closure edge (34) are each formed from two downwardly directed, rectilinear edge legs (37, 38 and 39, 40, respectively) arranged at an angle to one another, the edge legs (37, 38) of the lid closure edge (33) being oriented at a larger angle to one another than the edge legs (39, 40) of the mating closure edge (34) such that, with the lid (11) closed, the edge legs (37 . . . 40) bound a V-shaped or arrowhead-shaped opening (43).

4. Hinge-lid box according to claim 1, characterized in that the V-shaped opening (43), bounded by edge legs (37 . . . 40), extends over the fall width of the box front wall (15) and lid front wall (19), in particular as far as lateral (cross-sectionally right-angled) pack edges (35, 36).

5. Hinge-lid box according to claim 1, characterized in that, in the case of octagonal packs, that is to say with bevelled pack edges (35, 36), or round-edge packs, that is to say with round pack edges (35, 36), the opening (43) is directed as far as the inner contour of the pack edges (35, 36), in particular as far as inner edges (57) of the bevelled pack edges (35, 36) or as far as the inner boundary of a folding strip (59) for round edges.

6. Hinge-lid box according to claim 1, characterized in that the V-shaped opening (43) extends into the region of bevelled or round pack edges (35, 36), in particular as far as the lateral boundary of the same, that is to say as far as the outer edge (56) of a bevelled, or as far as the outer contour of the folding strip of a rounded, pack edge (35, 36).

7. Hinge-lid box according to claim 1, characterized in that the transverse dimension of the opening (43) is smaller than that of the box front wall (15) or lid front wall (19), and in that the lid closure edge (33) and the mating closure edge (34), adjoining the opening (43), run, in particular, horizontally, the closure edges (33, 34) butting against one another when the lid (11) is closed.

8. Hinge-lid box according to claim 1, characterized in that the opening (43) is positioned eccentrically in the region of the front side, in particular such that the opening (43) terminates, on one side, in the region of the upright pack edges (35) or of the inner edge (57) or of the folding strip (59) and, on the opposite side, at a distance from the associated pack edge (36).

9. Hinge-lid box according to claim 1, characterized in that the collar (27) is adapted, in terms of a cutout (31) in the region of the collar front wall (28), to the contour of the lid closure edge (33) and mating closure edge (34), in particular with edge sections (47), which run in a V-shaped manner in relation to one another, parallel to the lid closure edge (33) or to the mating closure edge (34), the edge sections (47) converging at a rounded point (48) which is positioned on the same imaginary line as points (41, 42) of the closure edges (33, 34).

10. Hinge-lid box according to claim 1, characterized in that a lid inner tab arranged on the inside of the lid front wall 25 (19) comprises two sub-tabs (50, 51) which are each connected to the edge leg (37, 38) of the lid front wall (19) via an obliquely directed folding line (52).

* * * * *